US012269569B2

(12) United States Patent
Wingren

(10) Patent No.: US 12,269,569 B2
(45) Date of Patent: Apr. 8, 2025

(54) PROPULSION CONTROL ARRANGEMENT FOR A MARINE VESSEL

(71) Applicant: VOLVO PENTA CORPORATION, Gothenburg (SE)

(72) Inventor: Jon Wingren, Nödinge (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 528 days.

(21) Appl. No.: 17/649,278

(22) Filed: Jan. 28, 2022

(65) Prior Publication Data

US 2022/0242542 A1 Aug. 4, 2022

(30) Foreign Application Priority Data

Feb. 4, 2021 (EP) ..... 21155277

(51) Int. Cl.
*B63H 21/21* (2006.01)
*B63H 21/17* (2006.01)
*B63H 23/08* (2006.01)

(52) U.S. Cl.
CPC ..... *B63H 21/213* (2013.01); *B63H 21/17* (2013.01); *B63H 23/08* (2013.01); *B63H 2021/216* (2013.01)

(58) Field of Classification Search
CPC ..... B63H 21/00; B63H 21/17; B63H 21/213; B63H 2021/216; B63H 23/00; B63H 23/08
USPC ..... 440/86
See application file for complete search history.

(56) References Cited

U.S. PATENT DOCUMENTS

| | | | | |
|---|---|---|---|---|
| 9,248,898 | B1 | 2/2016 | Kirchhoff et al. | |
| 10,343,759 | B2 * | 7/2019 | Despineux | B63H 21/213 |
| 10,377,458 | B1 | 8/2019 | Mcginley | |
| 2016/0375975 | A1 | 12/2016 | Fell | |
| 2018/0134362 | A1 | 5/2018 | Despineux | |

FOREIGN PATENT DOCUMENTS

| | | | |
|---|---|---|---|
| EP | 3689736 | A1 | 8/2020 |
| WO | 2019214829 | A1 | 11/2019 |

OTHER PUBLICATIONS

European Search Report dated Jul. 23, 2021 in corresponding European Patent Application No. 21155277.3, 7 pages.

* cited by examiner

*Primary Examiner* — Lars A Olson
(74) *Attorney, Agent, or Firm* — Venble LLP; Jeffri A. Kaminski

(57) ABSTRACT

A propulsion control arrangement operable to control a speed and possible direction of a marine vessel. A marine propulsion control system controlling a carried by a hull of a marine vessel, wherein the marine propulsion control system is adapted to receive an input command from the propulsion control arrangement.

13 Claims, 3 Drawing Sheets

PROPULSION CONTROL ARRANGEMENT FOR A MARINE VESSEL

TECHNICAL FIELD

The present disclosure generally relates to a propulsion control arrangement operable to control a speed and possible direction of a marine vessel. The present disclosure also relates to a marine propulsion control system controlling a propulsion unit carried by a hull of the marine vessel, wherein the marine propulsion control system is adapted to receive an input command from the propulsion control arrangement.

BACKGROUND

Today's marine vessels are often equipped with a plurality of propulsion units for driving the vessel. In a typical implementation, the marine vessel comprises a steering wheel for controlling a direction of the marine vessel and a propulsion control arrangement at least one propulsion control arrangement comprising a movable lever for controlling a speed and direction of the propulsion units.

An example of such an implementation is disclosed in U.S. Pat. No. 9,248,898, where the lever of an operator input device is moveable between a neutral detent position and a forward detent position. The introduction of the detent positions allows the operator of the vessel to physically detect when the lever has moved into a new shift position by providing resistance when the lever has moved into a given detent position. Typically, a general linear resistance force is provided when the lever is moved between the neutral detent position and the forward detent position.

A further development of propulsion control arrangements for marine vessels are disclosed in U.S. Ser. No. 10/377,458. In U.S. Ser. No. 10/377,458, it is suggested to subdivide an operational range from the neutral position and a maximum forward position into a low range and a high range, where a low resistance force is applied when the lever is within the low range and with an in comparison higher resistance force is applied when the lever is within the high range. Such an implementation will provide for an improved tactile experience when operating the vessel, inherently informing the operator of an intermediate speed that currently is being requested.

The solution presented in U.S. Ser. No. 10/377,458 will greatly improve operator perception of how the vessel is currently operated, specifically for a novice operator, due to the perceived feedback when moving the lever. However, the solution presented in U.S. Ser. No. 10/377,458 is limited to providing feedback when the lever is moved. Accordingly, when the lever has been moved to a specific position, it is necessary for the operator to rely on other feedback means to be informed about the current speed being requested. With the above in mind, there appears to be room for further improvements in regards to propulsion control arrangement adapted for improved vessel control, specifically focused on achieving an overall reliability of operating a marine vessel.

SUMMARY

In accordance to another aspect of the present disclosure, the above is at least partly alleviated by means of a propulsion control arrangement operable to provide speed commands for controlling a marine vessel, the propulsion control arrangement comprising a movable lever extending on an axis and adapted to be manually tilted by an operator from a neutral position to a maximum forward position, wherein an operational range between the neutral position and the maximum forward position comprises a first and a second sub-range separated by an intermediate position, the first sub-range arranged between the neutral position and the intermediate position, the intermediate position is different from the neutral position, adjustable and selected depending on a pre-set operational parameter for the marine vessel, and the propulsion control arrangement further comprising means arranged to automatically return the movable lever to the intermediate position and to stay at the intermediate position if the movable lever is released within the second sub-range.

In accordance to the present disclosure, the idea is to allow for an improved operation of the marine vessel, ensuring that the lever is not remaining in an unintended position for a prolonged time. Rather, as defined above, the movable lever will automatically return to a predefined intermediate position when the operator releases the movable lever. Due to the automatic return functionality, the operator will typically not only perceive a resistance but rather an "opposing force", for example if the automatic return functionality is implemented using a spring arrangement (or similar).

Within the context of the present disclosure, it should also be understood that the automatic return functionality is not implemented throughout the operational range between the neutral position and the maximum forward position, since such an implementation would result in a need for the operator to always keep a hand at the movable lever to ensure that the vessel is moving forward. Thus, in line with the present disclosure the automatic return functionality provides the advantage of being only active within the second sub-range, i.e. between the intermediate position and the maximum forward position. Within the first sub-range, being between neutral position and the intermediate position it is generally desirable to ensure that the movable lever "stays" when the operator moves his hand away from the lever, while at the same time applying a frictional resistance.

A further advantage following an implementation according to the present disclosure is that the present disclosure allows for the intermediate position to be adjusted and selected depending on a pre-set operational parameter for the marine vessel. When for example operating in the speed control domain, this effectively allows for the possibility to selectively define a speed (at the intermediate position) over which the movable lever will automatically return (to the intermediate position). Similarly, the intermediate position could equally be seen as to be used for selectively defining a trust level.

The automatic return functionality could, as indicated above, be implemented using a spring arrangement. That said, within the context of the present disclosure it is of course possible to provide such a functionality using other means, such as for example by using an electrically controlled stepper motor or any other form of suitable electrically or pneumatically controlled actuator. Other similar possibilities are of course possible and within the scope of the present disclosure. Using a spring arrangement may in some embodiments be desirable due to the simplicity following such an implementation. That said, using an electrically controlled stepper motor (or similar) may provide advantages as to the controllability of opposing force provided by the automatic return functionality. Possibly, the automatic return functionality may be implemented linearly (as compared to when using a spring), or according to any form of tactile scheme.

The intermediate position may in some embodiments be manually adjusted, for example by the operator or a captain of the vessel. As an example, the operator/captain could possibly select (and adjust) the intermediate position depending on an observed speed limitation for the area where the marine vessel is currently operating. It may however in some embodiments of the present disclosure be desirable to allow for the possibility to automatically adjust the intermediate position. This may in such embodiment be solved by making use of means for electrically adjusting the intermediate position, such as by (again) using a stepper motor, server motor, actuator or similar.

Within the context of the present disclosure it should be understood that the expression "speed commands" should be interpreted in the broadest sense. For example, it may be possible, and within the scope of the present disclosure, to allow the speed commands to directly control a speed of the marine vessel, or to control e.g. a level of revolution (rpm) or a torque of the marine vessel to indirectly control the speed of the marine vessel. It may of course be possible to allow the speed commands to in other ways directly or indirectly control the speed of the vessel.

It may when implementing the propulsion control arrangement, to allow for an automatic adjustment of the intermediate position, be desirable to arrange the propulsion control arrangement in communication (or to comprise) a control unit. The control unit is in turn arranged to control the stepper motor (or similar) to adjust the intermediate position based on the pre-set operational parameter for the marine vessel.

By implementing an automatic governance of the adjustable intermediate position, it may be possible to safeguard against legal, environmental, or economical demands and limits set for the marine vessel. The information fed to the propulsion control arrangement, defined by the pre-set operational parameter for the marine vessel, may as will be discussed below be dependent on positioning systems and digital maps. The information may also be formed, at least in part, by additional sensory capacity onboard the marine vessel, proximity and/or two-way communication, such as for example by using an automatic identification system (AIS) or similar.

As an example and in line with the discussion above, the pre-set operational parameter may in some embodiments be received, at the control unit, from a navigation control system of the marine vessel. The navigation control system may in turn be arranged in communication with a GPS receiver (or similar) and provided with a navigation information database. The navigation information database in conjunction with information from the GPS received be used for automatically determining a maximum speed for the area where the marine vessel is currently operating. The maximum speed may then be translated to the pre-set operational parameter for controlling the intermediate position. It should be noted that it in such an implementation may be desirable to form the pre-set operational parameter to correspond to a portion of the maximum speed, such as for example 70%-95% of the maximum speed. Other ranges are of course possible and within the scope of the present disclosure.

It should however be specifically noted that the pre-set operational parameter for the marine vessel not necessarily have to be dictated based on a maximum speed for the area where the marine vessel is currently operating. Rather, it may within the scope of the present disclosure be possible to adapt the navigation control system to hold other type of information that could be used for determining the pre-set operational parameter for the marine vessel. Such information may for example include a general policy dictated by an entity in charge of the marine vessel. For example, the entity in charge of the marine vessel may have a desire to generally ensure that the marine vessel is operated below a maximum speed for the vessel, since operation at the maximum speed for the vessel results in an in comparison high energy consumption. Rather, it may be desirable to set the intermediate position at a lower level where the energy consumption is in comparison lower. At the same time, the scheme according to the present disclosure does not limit the operational range of the marine vessel, since the operator easily may exceed the intermediate position when needed, possibly for safety reasons.

It may generally, but not necessarily, be desirable to allow the movable lever to also be allowed to be manually tilted from the neutral position to a maximum rearward position. Moving the lever towards the rearward position is generally used for adjusting the direction of the marine vessel, such that the vessel is moving backwards. The further the lever is moved towards the maximum rearward position, the higher the backward speed of the marine vessel. In a possible embodiment it may be possible to implement the division of the operational range for the lever when moving in towards the maximum rearward position in the same manner as when moving the lever towards the maximum forward position, including the above discussed automatic return functionality.

Furthermore, in some embodiments it may also be possible to allow the lever to be tilted from the neutral position in any arbitrary direction in addition to the forward and rearward direction, such as in a leftward rightward direction. Moving the lever in the leftward and rightward direction may be used for directing the marine vessel in corresponding directions. Furthermore, it may in some embodiments of the present disclosure be possible to allow the movable lever to be rotatable around the axis for providing rotational commands for controlling the marine vessel. That is, the propulsion control arrangement may in such an embodiment advantageously be used for "twisting" the marine vessel (yaw). Specifically, by rotating/twisting the movable lever, the marine vessel is controlled to rotate/twist. The twisting/rotating action may preferable be allowed to be performed both in a clockwise and an anti-clockwise manner, thus rotating/twisting the vessel in a corresponding manner.

It is further preferred to implement the twisting/rotating of the movable lever such that the movable lever automatically may return back to a rotational neutral position thereof, e.g. once the operator lets go of the movable lever. Such an implementation may for example comprise one of a plurality of springs for achieving the return function.

In a further embodiment of the present disclosure, it may be possible to provide the propulsion control arrangement with feedback means adapted to create a haptic effect perceivable at the movable lever. Accordingly, depending on e.g. the direction of inclination of the movable lever (such as at an end position in regards to inclination), the operator holding e.g. a hand at the movable lever may be given feedback, typically without the operator having to look at the movable lever for determining in what direction the movable lever is inclined. The haptic effect may also be provided for different purposes, e.g. for indicating an upcoming obstacle in case the vessel is to continue to move in the current direction, etc., based on e.g. information received from another control system comprised with the vessel.

In line with the discussion above, it may in line with the present disclosure be possible to provide a marine propulsion control system controlling a set of propulsion units carried by a hull of a marine vessel, the marine propulsion control system comprising a propulsion control arrangement as discussed above and a navigation control system comprising a digital map, wherein the control system is adapted to determine, using the navigation control system, present coordinates for the vessel, determine, using the navigation control system, a speed limit based on the present coordinates and the digital map, and adjust the intermediate position for the propulsion control arrangement based on the speed limit. Any number of propulsion units may be comprised with the marine vessel, such as e.g. at least a first and a second. Further propulsion units may for example be included, such as e.g. a bow thruster.

Further advantages and advantageous features of the present disclosure are disclosed in the following description and in the dependent claims.

BRIEF DESCRIPTION OF THE DRAWINGS

With reference to the appended drawings, below follows a more detailed description of embodiments of the present disclosure cited as examples.

In the drawings.

DETAILED DESCRIPTION

Figure 1:
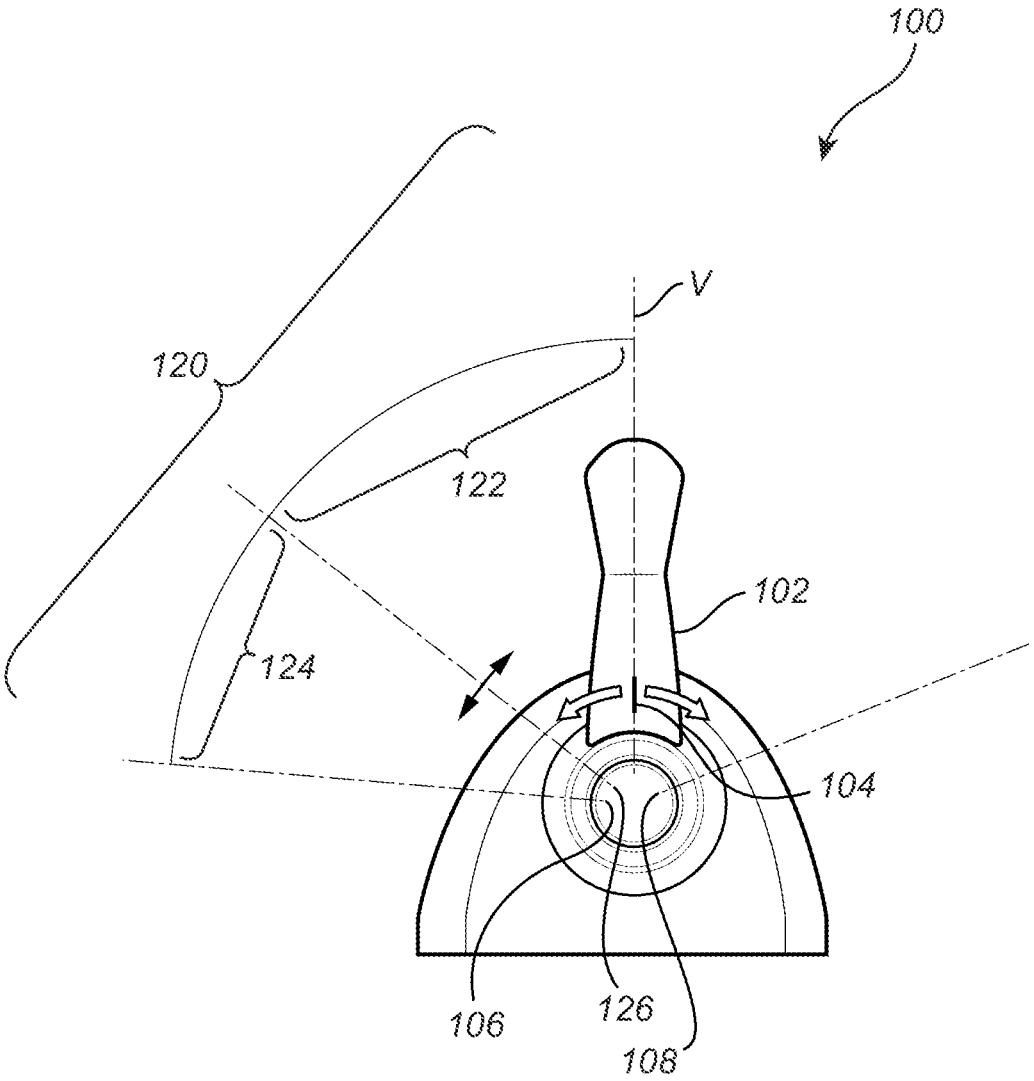
FIG. 1 conceptually illustrates a propulsion control arrangement according to a currently preferred embodiment of the present disclosure, FIG. 2 provides an illustrative example of a marine propulsion control system comprising the propulsion control arrangement as shown in FIG. 1, and FIG. 3 exemplifies a marine vessel comprising a marine propulsion control system as shown in FIG. 2 for operating the marine vessel.

The present disclosure will now be described more fully hereinafter with reference to the accompanying drawings, in which currently preferred embodiments of the present disclosure are shown. This disclosure may, however, be embodied in many different forms and should not be construed as limited to the embodiments set forth herein; rather, these embodiments are provided for thoroughness and completeness, and fully convey the scope of the disclosure to the skilled addressee. Like reference characters refer to like elements throughout.

Figure 3:
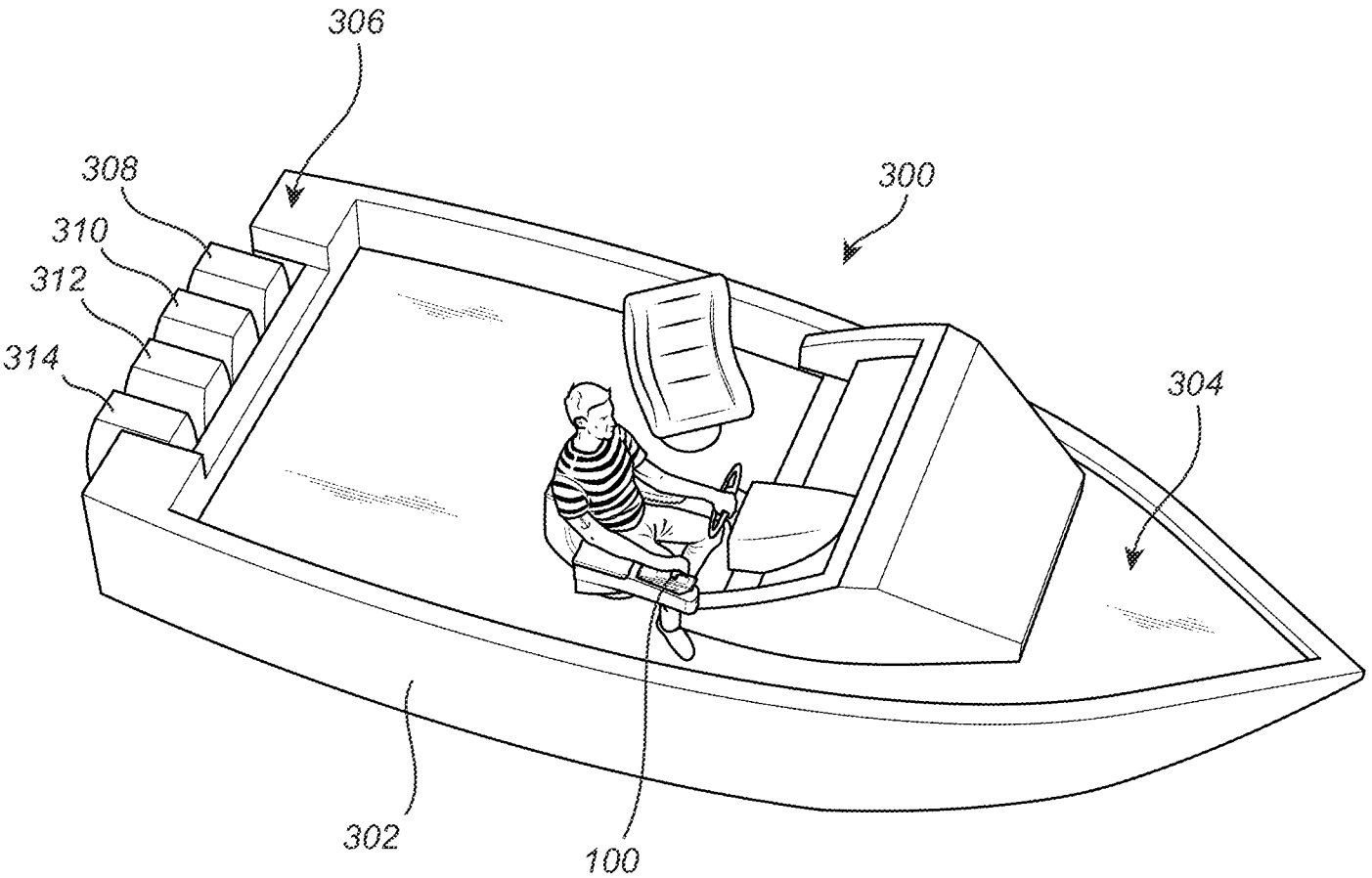

Referring now to the drawings and to FIG. 1 in particular, there is conceptually depicted a propulsion control arrangement 100 adapted for controlling a marine vessel 300 (as is illustrated in FIG. 3). The propulsion control arrangement 100 comprises a movable lever 102 extending on an axis V and adapted to be manually tilted by an operator from a neutral position 104 to a maximum forward position 106. When the movable lever 102 is in the neutral position 104 it is generally desirable that propulsion units (e.g. 308, 310, 312 and 314 as also shown in FIG. 3) are disengaged or at least "non-active" to not propel the marine vessel 300. Accordingly, when the movable lever 102 is in the neutral position 104 it may generally be desirable that speed commands for controlling the marine vessel 300 are to control the propulsion units 308, 310, 312, 314 to be non-active. However, when the operator tilts the lever 102 forward, then speed commands are formed to activate the propulsion units 308, 310, 312, 314 to propel the marine vessel 300 in a forward direction. Generally, the further the lever 102 is moved towards the maximum forward position 106, the faster the forward speed of the marine vessel 300.

In some embodiments, and as illustrated in FIG. 1, it may be desirable to also allow the lever 102 to be moved from the neutral position 104 to a maximum rearward position 108. Similar to the discussion above, the further the lever 102 is moved towards the maximum rearward position 108, the faster the backward speed of the marine vessel 300.

In accordance to the present disclosure and as is illustrated in FIG. 1, it is desirable to define an operational range 120 between the neutral position and the maximum forward position comprises a first 122 and a second 124 sub-range separated by an intermediate position 126, the first sub-range 122 arranged between the neutral position 104 and the intermediate position 126. The movable lever 102 is in accordance to the present disclosure adapted to provide different "feedback" to the operator depending of if the movable lever 102 is currently positioned within the first 122 or the second 124 sub-range. Specifically, when the movable lever 102 is within the first sub-range 122, it may be desirable to allow a minor frictional feedback to be provided to the operator. When the operator removes his hand from the movable lever 102, the movable lever 102 will stay in the position where the movable lever 102 was left.

However, when the movable lever 102 is moved forward past the intermediate position 126 and into the second sub-range 126, the general frictional feedback is substituted to an opposing force, for example implemented using a spring arrangement. Furthermore, when the operator removes his hand from the movable lever 102, the movable lever 102 will "spring back" to the intermediate position 126.

The intermediate position 126 is in accordance to the present disclosure adjustable, depending on a pre-set operational parameter for the marine vessel 300. As discussed above and with further reference to FIG. 2, the pre-set operational parameter for the marine vessel 300 may for example be manually selected and adapted by the operator, by a captain of the marine vessel 300, or automatically for example using means for electrically adjusting the intermediate position. Such means may for example include an actuator, a servo motor (not shown) or a stepper motor (not shown).

The actuator or a stepper motor may in turn be controlled using a control unit (not shown) that has been adapted to receive the pre-set operational parameter for the marine vessel, and to operate the actuator or stepper motor for electrically adjusting the intermediate position based on the received pre-set operational parameter. For reference, the control unit comprises processing circuitry arranged to at least in part perform the scheme according to the present disclosure. The processing circuitry may for example be manifested as a general-purpose processor, an application specific processor, a circuit containing processing components, a group of distributed processing components, a group of distributed computers configured for processing, a field programmable gate array (FPGA), etc. The processor may be or include any number of hardware components for conducting data or signal processing or for executing computer code stored in memory. The memory may be one or more devices for storing data and/or computer code for completing or facilitating the various methods described in the present description. The memory may include volatile memory or non-volatile memory. The memory may include database components, object code components, script components, or any other type of information structure for supporting the various activities of the present description. According to an exemplary embodiment, any distributed or local memory device may be utilized with the systems and methods of this description. According to an exemplary embodiment the memory is communicably connected to the processor (e.g., via a circuit or any other wired, wireless, or network connection) and includes computer code for executing one or more processes described herein.

Figure 2:
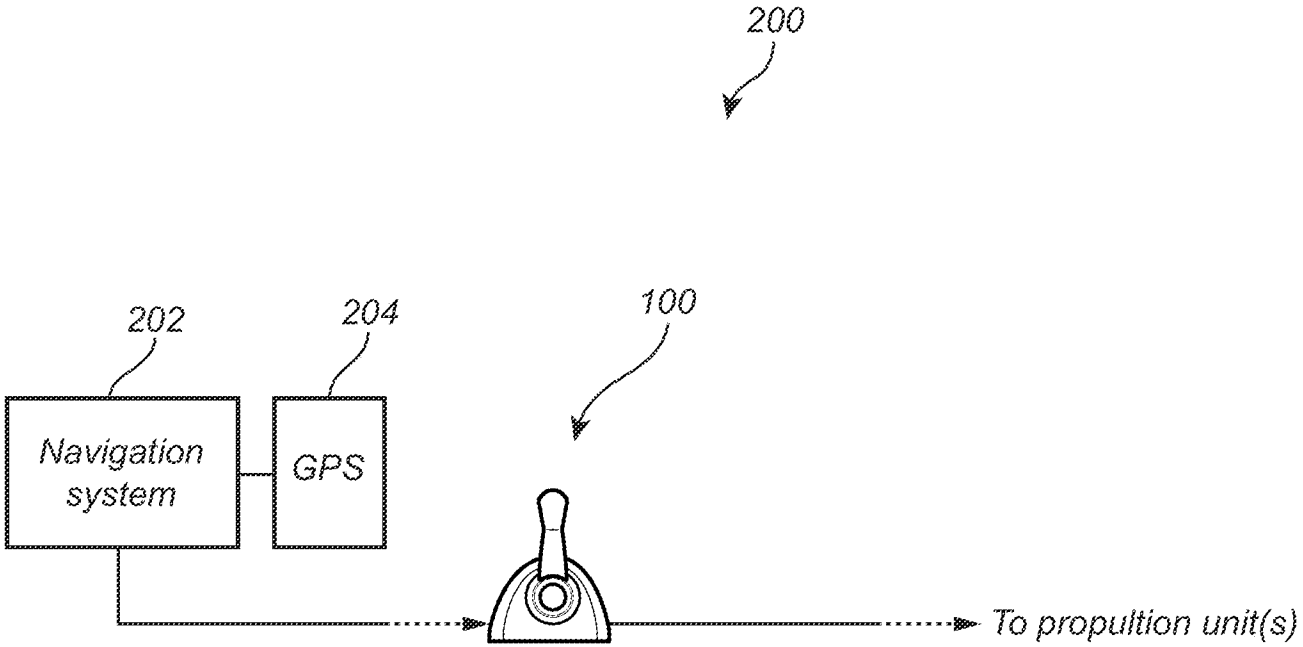

In some embodiments, and with further reference to FIG. 2 it may be desirable to allow the propulsion control arrangement 100 to be comprised with a marine propulsion control system 200, where the marine propulsion control system 200 further comprises a navigation control system 202. In some embodiments it may be possible to adapt the navigation control system 202 to be arranged in communication with e.g. a GPS receiver 204 and to comprise e.g. a digital map being representative of at least the area where the marine vessel 300 is currently positioned. It may further be possible to adapt the navigation control system 202 to determine present coordinates for the vessel 300 based on information received from the GPS receiver 204.

Based on the present coordinates for the vessel 300 and the digital map it could be possible to determine a present speed limit for the area where the marine vessel 300 is located. The speed limit may in turn be used for selecting the pre-set operational parameter for the marine vessel 300. As such, the speed limit influences the intermediate position 126 of the propulsion control arrangement 100. It may, as indicated above, be desirable to select the intermediate position 126 such that when the movable lever is positioned at the intermediate position 126, the marine vessel 300 is operating at a slightly lower speed as compared to the determined speed limit for the area where the marine vessel 300 is currently located.

It should be explicitly noted that other factors may influence the selection of the pre-set operational parameter for the marine vessel 300, in turn used for adjusting the intermediate position 126 of the propulsion control arrangement 100. As an example, if it has been determined that the marine vessel 300 has an optimal energy efficiency at specific engine speeds (e.g. rpm), then the pre-set operational parameter may be selected to influence the intermediate position 126 of the propulsion control arrangement 100. As such, in case an operator removes his hand from the movable lever 102 when in the second sub-range 124, the lever 102 will automatically spring back to the intermediate position 126 and as such be operating at the optimal energy efficiency. Such an implementation may have a great impact on the overall energy efficiency for operating the marine vessel 300, specifically for a novice operator.

Turning finally to FIG. 3, there is shown an example of a marine vessel 300 comprising a marine propulsion control system 200 for operating the marine vessel 300 using the propulsion control arrangement 100 as defined in accordance to the present disclosure.

In the illustration provided, the vessel 300 is designed with a hull 302 having a bow 304, a stern 306. In the stern 306, four propulsion units 308, 310, 312 and 314 may be mounted. The propulsion units 308, 310, 312 and 314 may be pivotally arranged in relation to the hull 302 for generating a driving thrust in a desired direction of a generally conventional kind. The propulsion units may alternatively be inboard propulsion units, mounted under the vessel on the hull 302, or mounted on the stern 306 as so called stern drives. That is, the propulsion units 308, 310, 312 and 314 may be outboard propulsion units or inboard propulsion units.

It should be understood that the vessel 300 may be provided with more than four (or less) propulsion units. Furthermore, the vessel 300 may be provided with e.g. a bow thruster (not shown) for assisting in "moving" the bow 304, e.g. in windy situations. The 308, 310, 312 and 314, as well as the bow thruster, are operated based on the commands generated when tilting and/or rotating the movable lever 102 in a manner as discussed above.

In summary, the present disclosure relates to a propulsion control arrangement operable to provide speed commands for controlling a marine vessel, the propulsion control arrangement comprising a movable lever extending on an axis and adapted to be manually tilted by an operator from a neutral position to a maximum forward position, wherein an operational range between the neutral position and the maximum forward position comprises a first and a second sub-range separated by an intermediate position, the first sub-range arranged between the neutral position and the intermediate position, the intermediate position is different from the neutral position, adjustable and selected depending on a pre-set operational parameter for the marine vessel, and the propulsion control arrangement further comprising means arranged to automatically return the movable lever to the intermediate position and to stay at the intermediate position if the movable lever is released within the second sub-range.

Advantages following the present disclosure include for example improvements as to the perceived feedback provided when handling the movable lever of the propulsion control arrangement, as well as possibly a lower energy consumption and thus a lower environmental impact when propelling the marine vessel.

The present disclosure contemplates methods, devices and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor.

By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data that cause a general-purpose computer, special purpose computer, or special purpose processing machines to perform a certain function or group of functions.

Although the figures may show a specific order of method steps, the order of the steps may differ from what is depicted.

In addition, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps. Additionally, even though the disclosure has been described with reference to specific exemplifying embodiments thereof, many different alterations, modifications and the like will become apparent for those skilled in the art.

Variations to the disclosed embodiments can be understood and effected by the skilled addressee in practicing the claimed disclosure, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A marine propulsion control system adapted to control a propulsion unit carried by a hull of a marine vessel, the marine propulsion control system comprising:

a navigation control system comprising a digital map, and a propulsion control arrangement operable to provide speed commands for controlling a marine vessel, the propulsion control arrangement comprising a movable lever extending on an axis and adapted to be manually tilted by an operator from a neutral position to a maximum forward position, wherein:

an operational range between the neutral position and the maximum forward position comprises a first and a second sub-range separated by an intermediate position, the first sub-range arranged between the neutral position and the intermediate position, the intermediate position is different from the neutral position, adjustable and selected depending on a pre-set operational parameter for the marine vessel, and the propulsion control arrangement further comprising means arranged to automatically return the movable lever to the intermediate position and to stay at the intermediate position if the movable lever is released within the second sub-range, wherein the control system is adapted to:

determine, using the navigation control system, present coordinates for the vessel, determine, using the navigation control system, a speed limit based on the present coordinates and the digital map, and adjust the intermediate position for the propulsion control arrangement based on the speed limit.

2. The marine propulsion control system according to claim 1, wherein means arranged to automatically return the movable lever to the intermediate position comprises a spring.

3. The marine propulsion control system according to claim 1, further comprising means for manually adjusting the intermediate position.

4. The marine propulsion control system according to claim 1, further comprising means for electrically adjusting the intermediate position.

5. The marine propulsion control system according to claim 1, wherein the movable lever remains at a position within the first sub-range if the movable lever is released.

6. The marine propulsion control system according to claim 1, wherein a predefined level of a frictional resistance is applied when the movable lever is moved within the first sub-range.

7. The marine propulsion control system according to claim 4, further comprising a control unit connected to the means for electrically adjusting the intermediate position, wherein the control unit is adapted to:

received the pre-set operational parameter for the marine vessel, and operating the means for electrically adjusting the intermediate position based on the received pre-set operational parameter.

8. The marine propulsion control system according to claim 1, wherein means for electrically adjusting the intermediate position comprises an actuator.

9. The marine propulsion control system according to claim 7, wherein the pre-set operational parameter is received from a navigation control system for the marine vessel.

10. The marine propulsion control system according to claim 1, wherein the movable lever is further adapted to be manually tilted from the neutral position to a maximum rearward position.

11. The marine propulsion control system according to claim 1, wherein the movable lever is further adapted to be rotatable around the axis.

12. A marine vessel, comprising:

a propulsion unit, and a marine propulsion control system according to claim 1.

13. The marine vessel according to claim 12, wherein the propulsion unit comprises at least a first and a second propulsion unit.

* * * * *